United States Patent [19]

Gedzelman

[11] 4,178,019

[45] Dec. 11, 1979

[54] DATE REMINDER CALENDAR

[76] Inventor: Milton Gedzelman, 80 Beekman St., New York, N.Y. 10038

[21] Appl. No.: 900,874

[22] Filed: Apr. 28, 1978

[51] Int. Cl.[2] ..... B42D 5/04

[52] U.S. Cl. ..... 283/2; 40/107

[58] Field of Search ..... 40/107, 110, 119, 121; 283/2, 15

[56] References Cited

U.S. PATENT DOCUMENTS

| | | | |
|---|---|---|---|
| 1,238,037 | 8/1917 | McKinnon | 40/107 |
| 1,601,119 | 9/1926 | Heaton | 40/107 |
| 1,898,137 | 2/1933 | Neely | 40/107 |
| 2,574,899 | 11/1951 | Waring | 40/110 |
| 2,582,355 | 1/1952 | Ratner | 40/107 |
| 2,831,278 | 4/1958 | Myers | 40/107 |
| 3,594,935 | 7/1971 | Blattstein | 40/107 |
| 3,911,606 | 10/1975 | Hunkins | 40/110 |
| 3,936,966 | 2/1976 | Zeiske | 40/107 X |
| 3,964,195 | 6/1976 | Jordan | 40/107 |
| 4,043,573 | 8/1977 | Griffin | 283/2 |

*Primary Examiner*—Robert L. Spicer, Jr.

*Attorney, Agent, or Firm*—Lackenbach, Lilling & Siegel

[57] ABSTRACT

A date reminder calendar includes a plurality of stacked sheets each representing a different date. Each of the sheets is provided with an elongate marking area which is adapted to be marked in a manner readily distinguishable from similar areas which have not been marked. Each sheet is formed with a plurality of elongate parallel openings or slots which are successively smaller in relation to the marking area and each of which is aligned with another marking area on another sheet. By stepping or displacing the marking areas from each other on successive sheets of a group of sheets to avoid overlap, a marked area becomes larger and more prominent with the removal of each successive sheet to thereby increasingly signify the imminency of the date and the reminder associated with the marked area.

12 Claims, 9 Drawing Figures

MON. JAN 1, 19--
APPOINTMENTS
REMINDERS

MON.
TUES.
WED.
THUR.
FRI.
SAT/SUN

TUES. JAN 2, 19--
REMINDERS

WED. JAN 3, 19--
REMINDERS

THURS. JAN 4, 19--
REMINDERS

DATE REMINDER CALENDAR

BACKGROUND OF THE INVENTION

The present invention generally relates to calendars, and, more specifically, to a calendar provided with an array of sequentially stepped slots or openings having successively different lengths to provide, over a given time period, continuous notice of the imminency of an important date and increasingly emphasizing, during the period in question, of the upcoming of that date.

Numerous reminder calendars and memorandum calendars have been proposed for providing an effective reminder of an important event or occasion which is scheduled to come up on a predetermined day. Typical of such prior art calendars are those disclosed in the following U.S. Pat. Nos. 1,601,119; 1,898,137; 2,582,355; 2,831,278; 3,594,935; 3,911,606; and 3,964,195. The calendars disclosed in these patents have generally not provided the desired result, either because they were difficult or inconvenient to use, or complicated in construction and, therefore, expensive to produce, or did not satisfy all the possible requirements or needs that one could normally have for such calendars.

For example, in U.S. Pat. No. 3,594,935, the memorandum pad was provided with stacked sheets corresponding to days of the year, with each succeeding sheet being provided with alternating windows or cutouts through which reminders could be written on and read from the succeeding sheet without moving or removing the overlying sheet. This was an attempt to permit the user to be warned or reminded of an event or appointment which was coming up on the following day. Accordingly, this prior art memorandum pad provided only one day's notice and could not serve as a continuous reminder over a longer period of time. The prior art memorandum pad did not, accordingly, provide the flexibility that one may need sometimes in scheduling all tasks that must be done or appointments which are coming up. Also, the prior art memorandum pad did not provide adequate notice in those cases where, for example, a report had to be ready by a certain date where a considerable amount of time was necessary to prepare such report.

SUMMARY OF THE INVENTION

Accordingly, it is an object of the present invention to provide a date reminder calendar which does not have the disadvantages associated with prior art calendars of this type.

It is another object of the present invention to provide a date reminder calendar which is simple in construction and economical to manufacture.

It is still another object of the present invention to provide a date reminder calendar which is simple and convenient to use.

It is yet another object of the present invention to provide a date reminder calendar which can provide notice or a reminder well in advance of the date of interest.

It is a further object of the present invention to provide a date reminder calendar which provides indications which are more prominent with the removal of each successive sheet to thereby increasingly signify the imminency of the upcoming date of interest.

In order to achieve the above objects, as well as other objects which will become apparent hereafter, the date reminder calendar in accordance with the present invention comprises a plurality of stacked sheets each representing a different date. The sheets are arranged in a plurality of like groups of sheets with each group representing a predetermined time period. At least one of the sheets of each group is provided with a marking area adapted to be marked in a manner readily distinguishable from similar areas which have not been marked. A number of sheets equal up to the number of sheets in the group being disposed above said marking area and being provided with openings generally aligned with each other and being successively larger the closer to said marking area. In this manner, each marking area becomes larger and more prominent with the removal of each successive sheet to thereby increasingly signify the imminency of the date and the reminder associated with the marked area.

BRIEF DESCRIPTION OF THE DRAWINGS

Further advantages of the invention will become apparent from a reading of the following specification describing illustrative embodiments of the invention. This specification is to be taken with the accompanying drawings in which.

DESCRIPTION OF THE PREFERRED EMBODIMENTS

Figures 1, 2, 4, 5, 6:
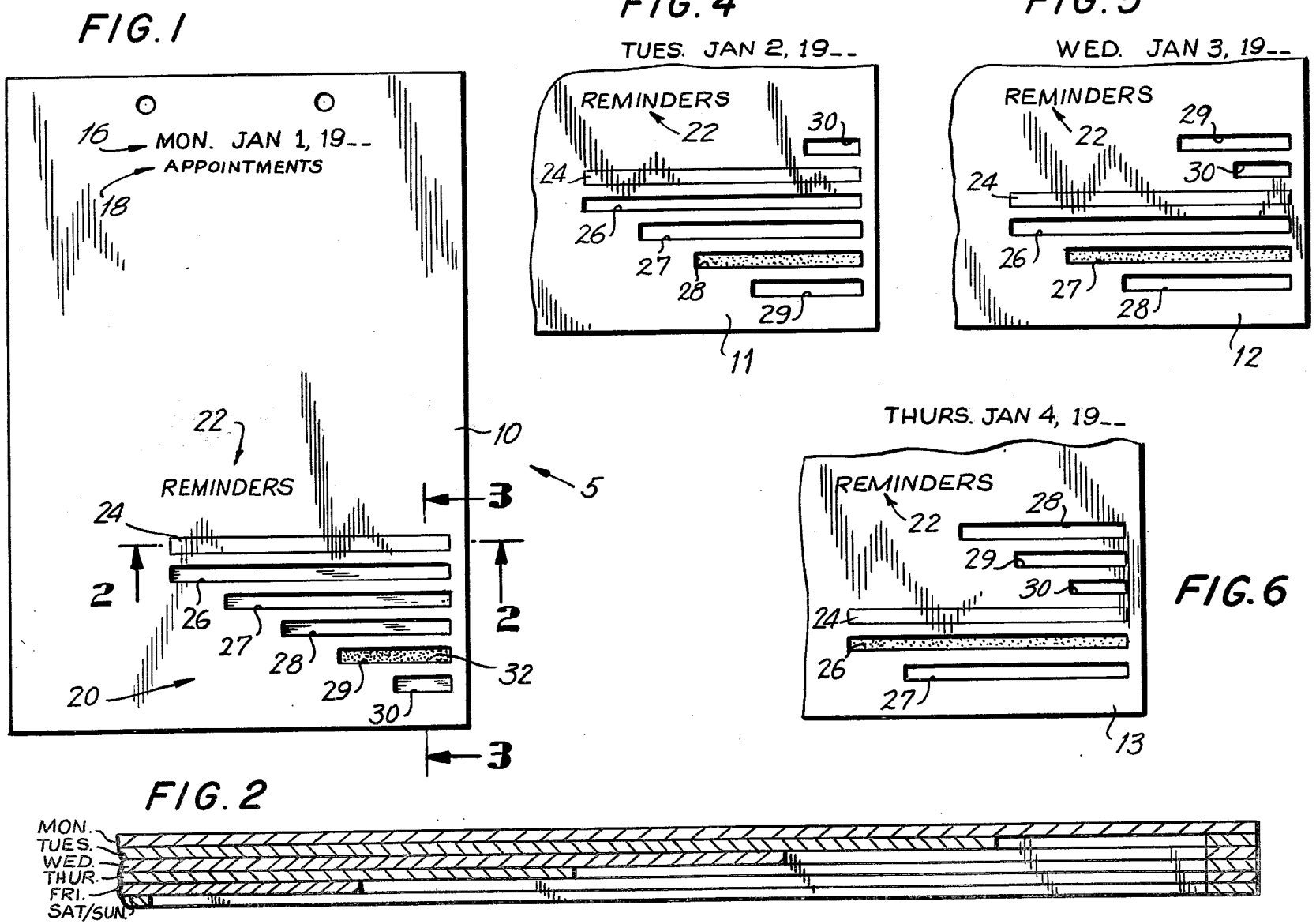
FIG. 1 is a top plan view of a date reminder calendar in accordance with the present invention, showing a marking area and a plurality of successively smaller slots through one of which there is visible a marked area on a sheet of the calendar associated with the date of interest.
FIG. 2 is a fragmented, enlarged cross-sectional view of the calendar shown in FIG. 1, taken along line 2—2.
FIGS. 4–8 are fragmented views of the portion of the calendar which serves to provide reminders in accordance with the present invention, showing the relative positions of the various slots and marked areas on successive days and, therefore, on successive adjacent sheets of the calendar.
Figure 3:
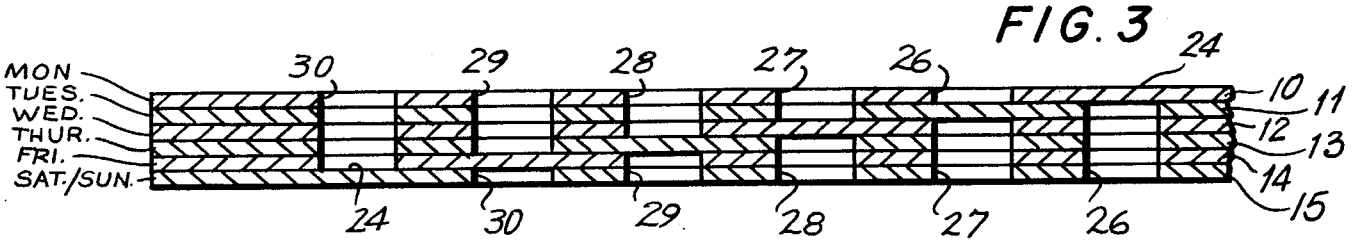
FIG. 3 is generally similar to FIG. 2, but is a cross-sectional view taken along line 3—3 in FIG. 1.
Figure 7:
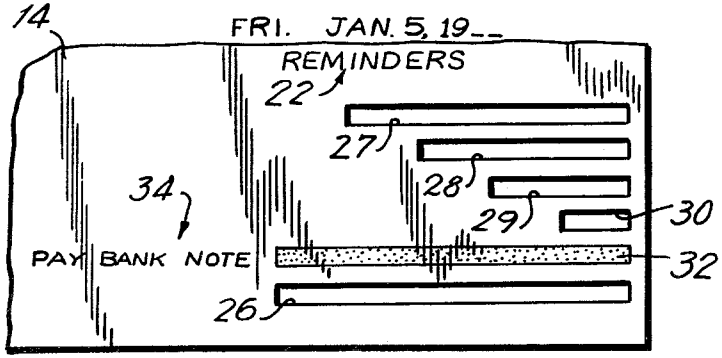
Figure 8:
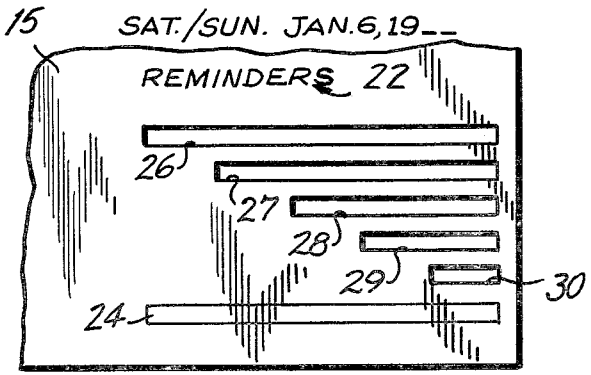

Referring now specifically to the figures, in which identical or similar parts are designated by the same reference numerals throughout, and first referring to FIG. 1, there is shown a date reminder calendar in accordance with the present invention and is generally designated by the reference numeral 5.

The calendar 5 includes a plurality of stacked sheets 10–15 (FIGS. 1–8) each representing a different date. Each sheet may be provided in a conventional manner with a date 16 and a heading "Appointments" 18 associated with an area for listing routine appointments, events, occasions, or general notes.

In the calendar being described, the reference numerals 10–14 respectively represent a specified week from Monday through Friday. The sheet 15 represents the weekend and covers the dates Saturday and Sunday, as is customary with business calendars. The sheets are thus arranged in a plurality of like groups of sheets with each group representing a predetermined time period. In the embodiment described, there are six sheets in each group which represents one week. However, as will become evident from the description that follows, the same invention can also be utilized with different numbers of sheets in each group representing different time periods. For example, it may be possible to use four sheets in a group, with each sheet representing a month, so that a group represents a quarter of the year. Twelve sheets in a group each representing a month would result in a group representing a one year period. The possibilities and combinations are limitless. The most common arrangement contemplated, however, is the one shown.

Provided in the lower region of each of the sheets is a reminder area or field generally designated by the reference numeral 20 and headed by the heading "Reminders" 22. In accordance with the broader aspects of the present invention, at least one of the sheets of each group is provided with a marking area 24 adapted to be marked in a manner readily distinguishable from similar areas which have not been marked. Thus, the marking area may be in the nature of an elongate strip or box marked off by lines as shown.

A number of sheets equal to the number of sheets in a group, six in the embodiment being described, are disposed above the marking area 24 and are provided with openings 26–30 generally aligned with each other and being successively larger the closer to the marking area.

The openings 26–30 are superimposed or aligned elongate slots having generally the same width as the marking area 24, but having different lengths equal to or smaller than the length of the marking area 24. Thus, the slot or opening 26 is equal to the marking area 24, while the successively adjacent slots 27–30 are increasingly shorter. The differences in the lengths between the slots 26–30 are substantially equal increments between adjacent slots, although this is not a critical feature of the present invention. By superimposing the elongated openings or slots above an associated marking area and aligning the slots therewith, the respective marking area becomes larger and more prominent with the removal of each successive sheet to thereby increasingly signify the imminency of the date and the reminder associated with the marked area.

In the embodiment shown in FIGS. 1–8, the elongate strip or marking area and the openings or slots are generally horizontal when normally viewing the calendar. However, as will be discussed in connection with FIG. 9, the specific orientation of the slots and marking areas are not critical.

In accordance with one feature of the present invention, the sheet directly above or adjacent to the sheet provided with a marking area of interest is substantially coextensive with and of the same size as the marking area. In this manner, as can best be seen in FIG. 6, the marked area 32 is entirely visible the day before the actual date of interest.

Although the present invention also contemplates the provision of a marking area 24 on only one sheet of each group, such as, for example, the Saturday/Sunday page 15, the presently preferred embodiment is provided with a marking area on each sheet of each group, the marking areas 24 on the different sheets being generally displaced from each other to avoid overlap when the same are all projected onto a plane generally parallel to the stacked sheets. Where marking areas are used on each of the sheets of a group, the elongate strip marking areas are generally parallel to each other and of equal length. The openings 26–30 associated with each marking area of each sheet of a group are superimposed or aligned elongate slots, as noted above. The openings or elongate slots associated with each marking area of a group are of different lengths, the marking areas on adjacent sheets being generally offset from each other a substantially uniform distance.

In the presently preferred embodiment, the marking areas 24 of each group are stepped from each other on successive sheets, along a direction substantially normal to the parallel direction, by a uniform distance. The openings or slots on a sheet above a marking area 24 on that sheet are successively larger the further removed from a respective marking area, and the openings or slots below the marking on the same sheet are successively smaller the further removed from the respective marking area. Thus, on the Monday sheet 10, the marking area 24 is at the top of the area or field 20, and the slots 26–30 below the marking area are successively smaller the further removed from the area 24. Referring to FIGS. 5 and 6, the openings or slots above the marking area 24 on each of those sheets are successively larger the further removed from the respective marking area, while the openings or slots below the respective marking areas are successively smaller the further removed from such marking areas.

Figure 9:
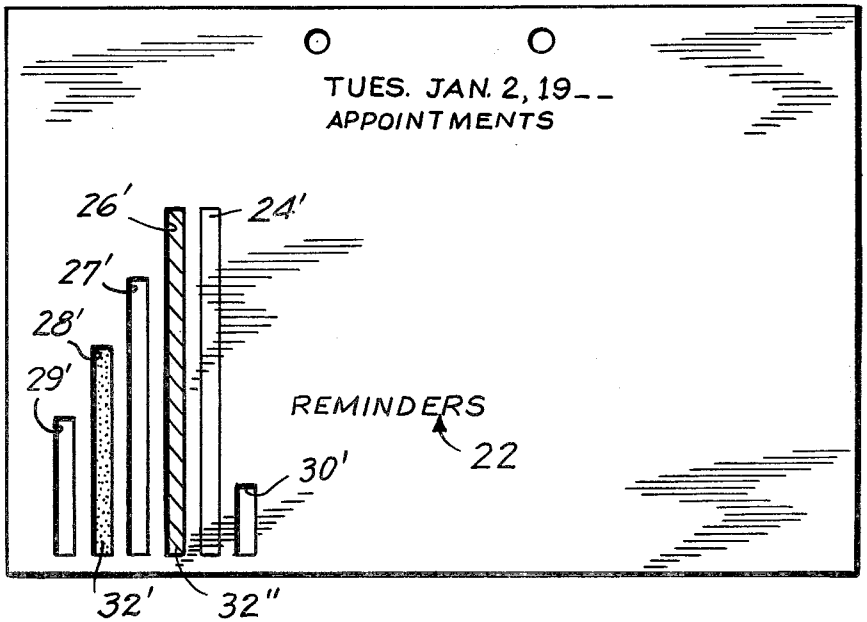
FIG. 9 is generally similar to FIG. 1, but showing a different embodiment of the invention, wherein the slots or openings and the marked and marking areas are vertical instead of horizontal.

Referring to FIG. 9, the same invention is illustrated wherein the marking area 24' as well as the openings or elongate slots 26'–30' are all parallel to each other and oriented in a substantially vertical direction when viewing the calendar. Otherwise, the various marking areas and slots or openings are spaced from each other and otherwise serve the same functions as described in connection with the first described embodiment.

In use of the date reminder calendar of the present invention, the respective marking area 24 associated with the date of interest is marked in a distinguishing manner, such as by coloring the same in a different color than the color of the calendar sheets or pages. The date of interest may be close or far removed from the present date. As soon as the date of interest falls within the current time period, or week in the embodiment being described, the page on which the marking area has been marked falls within the uppermost group of six pages. Initially, the smallest opening, slot or window 30 will expose the marked area and, on each succeeding day, when another sheet is removed, the marked area of interest will be exposed by a increasingly large opening, slot or window until, on the day before the date of interest, the entire marked area is exposed through the longest slot 26. Of course, on the actual date of interest, the marked area will be exposed directly and not through a window. At such time, any handwritten note 34 (FIG. 7) will also be visible to the user. In the embodiment shown, the date of interest is Friday, January 5, on which date a bank note is to be paid. On Monday, January 1, the reminder appears through the slot or window 29. However, on the succeeding days up to and including Thursday, January 4, the marked area 32 becomes increasingly larger until the full length thereof is exposed through the opening or slot 26. Finally, on Friday, January 5, the marked area is again fully displayed, now directly, together with whatever information may be necessary to complete the reminder.

The present date reminder calendar is simple in construction and very simple and convenient to use. All that is required is that the user proceed to the date of interest and mark or otherwise color the marking area 24. The calendar will automatically provide continuous reminders during the week preceding the critical date, each day the reminder being with greater urgency by displaying the marked area, which may have been colored in red, in greater and greater lengths to make the same more visible and prominent with the removal of each successive sheet. This effectively and increasingly signifies the imminency of the date and the reminder associated with the marked area.

While only one marked area 32 has been shown in FIGS. 1 and 4–7, users may, of course, highlight one or more marking areas 24 within the same week or group of sheets. In FIG. 9, for example, two marked areas 32' and 32'' are shown visible through respective openings or windows 28' and 26'. While the marked area 32'' signifies a reminder or an event to take place, in the example shown, on Wednesday, January 3, the marked area 32'' signifies an event to take place on Friday, January 5.

It should also be evident that while a conventional form of calendar has been shown wherein each of the dates is associated with a given day of the week, the present invention can also be used in conjunction with a perpetual calendar wherein each sheet is merely labelled by the date but the days of the week are omitted. Such a perpetual calendar can be used repeatedly and recurring occasions such as birthdays, anniversaries or other events celebrated annually can be brought to one's attention on a regular basis.

It may also be pointed out that while in the examples disclosed elongate slots and elongated locking areas have been shown, these can assume any other shape or configuration, such as circular, triangular, etc.

It is to be understood that the foregoing description of the various embodiments illustrated herein is exemplary and various modifications to the embodiments shown herein may be made without departing from the spirit and scope of the invention.

What is claimed:

1. A date reminder calendar comprising a plurality of stacked sheets each representing a different date, said sheets being arranged in a plurality of like groups of sheets with each group representing a predetermined time period, at least one of the sheets of each group being provided with a marking area adapted to be marked in a manner readily distinguishable from similar areas which have not been marked, a number of sheets equal up to the number of sheets in a group being disposed above said marking area and being provided with openings generally aligned with each other and being successively larger the closer to said marking area, whereby each marking area becomes larger and more prominent with the removal of each successive sheet to thereby increasingly signify the imminency of the date and the reminder associated with said marked area.

2. A date reminder calendar as defined in claim 1, wherein said predetermined time period is one week, and wherein seven sheets are provided in each group with one sheet representing each day of the week.

3. A date reminder calendar as defined in claim 1, wherein said predetermined time period is one week, and wherein six sheets are provided in each group with one sheet representing each working day of the week and one sheet representing the weekend.

4. A date reminder calendar as defined in claim 1, wherein said marking area is in the nature of an elongate strip, and said openings are superimposed or aligned elongate slots.

5. A date reminder calendar as defined in claim 4, wherein said elongate strip and openings are generally horizontal when normally viewing the calendar.

6. A date reminder calendar as defined in claim 4, wherein said elongate strip and openings are generally vertical when normally viewing the calendar.

7. A date reminder calendar as defined in claim 1, wherein the opening of the sheet directly above or adjacent to said sheet provided with said marking area is substantially coextensive with and of the same size as said marking area.

8. A date reminder calendar as defined in claim 1, wherein each of said sheets of each group is provided with a marking area, said marking areas on the different sheets being generally displaced from each other to avoid overlap when the same are all projected onto a plane generally parallel to said stacked sheets.

9. A date reminder calendar as defined in claim 8, wherein said marking areas are in the nature of elongate strips, and the openings associated with each marking area on each sheet of a group being superimposed or aligned elongate slots.

10. A date reminder calendar as defined in claim 9, wherein said elongate strip marking areas are generally parallel to each other and of equal length.

11. A date reminder calendar as defined in claim 10, wherein said openings or elongate slots associated with each marking area of a group are of different lengths, the marking areas on adjacent sheets being generally offset from each other a substantially uniform distance.

12. A date reminder calendar as defined in claim 1, wherein said marking areas of each group are stepped from each other on successive sheets, along a direction substantially normal to said parallel direction, by said uniform distance, whereby the openings or slots above a marking area on a sheet of a group are successively larger the further removed from a respective marking area, and the openings or slots below a marking area on the same sheet are successively smaller the further removed from a respective marking area.

* * * * *